US006199714B1

(12) United States Patent
Thompson

(10) Patent No.: US 6,199,714 B1
(45) Date of Patent: Mar. 13, 2001

(54) WASTE RECEPTACLE WITH SWEPT DEBRIS PICK UP AND FEATURES TO MAXIMIZE CONVENIENT USE OF RECEPTACLE LINERS

(76) Inventor: Charlotte Annette Vaughn Thompson, 106 South St., Bay Minette, AL (US) 36507

( * ) Notice: Subject to any disclaimer, the term of this patent is extended or adjusted under 35 U.S.C. 154(b) by 0 days.

(21) Appl. No.: 09/370,150

(22) Filed: Aug. 9, 1999

Related U.S. Application Data

(60) Provisional application No. 60/100,801, filed on Sep. 18, 1998.

(51) Int. Cl.[7] ..... B65D 25/00

(52) U.S. Cl. ..... 220/495.07; 220/495.04; 220/908

(58) Field of Search ..... 220/495.07, 495.04, 220/908, 908.1, 23.86

(56) References Cited

U.S. PATENT DOCUMENTS 4,294,379 * 10/1981 Bard ..... 220/495.04
5,535,910 * 7/1996 Cassel ..... 220/908 X
5,632,401 * 5/1997 Hurd ..... 220/495.07
5,738,239 * 4/1998 Triglia ..... 220/495.07
5,803,303 * 9/1998 Timm et al. ..... 220/495.04

* cited by examiner

*Primary Examiner*—Steven Pollard

(57) ABSTRACT

A waste receptacle with a open upper end, a closed lower end, sidewalls there between and a lid to enclose open upper end. A lower portion on a sidewall has an inwardly formed recess dimensioned to receive the toe and end portion of a human foot to hold receptacle when full liners are removed. As well as the same recess is also dimensioned to receive swept debris into a vacuum tube through an open recess within the inwardly formed recess of the lower sidewall. The vacuum tube is secured to inner sidewall of receptacle and is received into a removable debris storage container that is also removable received by a vacuum housing secured with in receptacle. Handles of receptacle bend open to receive and neatly secure bulky excess top portion of liner to receptacle. Handles of receptacle also collate with an outward extending ledge of receptacle lid to lock seal the receptacle. The receptacle lid has within its outwardly extending formed handle a sealed internal trash tie storage compartment. A versatile liner dispenser is mountable to desired position within receptacle to provide a continuos supply of liners to receptacle.

8 Claims, 3 Drawing Sheets

WASTE RECEPTACLE WITH SWEPT DEBRIS PICK UP AND FEATURES TO MAXIMIZE CONVENIENT USE OF RECEPTACLE LINERS

CROSS-REFERENCE TO RELATED APPLICATIONS

This application is entitled to the benefit of Provisional Application Ser. #60/100,801 filed Sep. 18, 1998 titled "Smart Can".

STATEMENT REGARDING FEDERALLY SPONSORED RESEARCH OR DEVELOPMENT.

"Not applicable"

REFERENCE TO A MICROFICHE APPENDIX

"Not applicable"

BACKGROUND FIELD OF THE INVENTION

This invention relates to receptacles, specifically to improve receptacles lining features of a receptacle and swept debris pick up means of a receptacle.

BACKGROUND-DISCUSSION OF PRIOR ART

Originally traditional waste receptacles where only capable of receiving waste manually placed into an open upper end of receptacle. Because of this a person sweeps debris into a pile then they have to retrieve the dustpan, bend over to gather the pile of debris onto dustpan. Then the person takes the dustpan to receptacle and empties the debris into receptacle. Often the person has to bang the dustpan on inside of receptacle to knock off any loose debris before returning the dustpan to storage.

This problem has been partially addressed by a waste receptacle with a sweeping ramp having protruding teeth in U.S. Pat. No. 5,924,162 to Kalscheur, Jul. 20, 1999. In which debris are manually swept into receptacle by the use of a sweeping ramp. The swept in debris are removed from tipping the waste receptacle causing a fold away top flap of a chute passage to open and pore out the swept material.

This patent to Kalscheur dose provide a way to receive and store swept material into receptacle. However, the sweep material storage in this receptacle is not lined and would require cleaning often.

Along with the need for an improved method for waste receptacles to receive swept debris are several needed improvements in receptacle design. One needed improvement of waste receptacles is an inexpensive method of neatly securing the bulky excess top portion of a liner that hangs over the top of receptacle. For neatness as well as to secure the liner in place when the receptacle user desires to turn the receptacle upside down to empty the contents of the lined receptacle into a dumpster or another separate liner for the purpose of reusing the liner already in receptacle.

U.S. Pat. No. 5,632,401 to Hurd, May 27, 1997 partially addresses this need by the use of a bag holding flange. Although the flange dose hold a portion of the liner secure at the very top of the open end of receptacle. It dose not neatly secure the bulky excess top portion of the liner that still hangs over top of receptacle. Also this receptacle can not conveniently be overturned to empty the contents of a liner within receptacle. Upon overturning this receptacle a supply of liners stored within the inner base of this receptacle would be released from a pair of spring hinged doors that are unsecured.

Another needed improvement of receptacles is simple inexpensive and versatile method of storing a continues supply of liners with receptacle. There have been several attempts to solve this need as demonstrated in U.S. Pat. Nos.; #3,481,112 to Bourgeois, Dec. 2, 1969 -# 3,451,453 to Heck, Jun. 24, 1969 -# 3,760,975 to Nilsson, Sep. 25, 1973 - #4,364,490 to Lang, Dec. 21, 1982 -#4,955,505 to Battaglia, Sep. 11, 1990 -#5,031,793 to Chen, Jul. 16, 1991 -#5,115,935 to Lemongelli, May 26, 1992 -#5,322,180 to Ker, Jun. 21, 1994 -#5,372,272 to Jennings, Dec. 13, 1994 -#5,458,259 to Falk, Oct. 17, 1995 -#5,405,041 to Van Brackle, Apr. 11, 1995 -#5,503,292 to Cuccharia, Apr. 2, 1996 -#5,628,424 to Gola, May 13, 1997

As this need for a liner dispenser has been well defined over the past 30 years many approaches to solve this need have been taught in the prior art. Tow the teachings of the prior art are great conceptually, it is apparent that the purpose of the patent law to make ideas public for the benefit of mankind has not been fully implemented for the following reasons:

The prior art efforts are commercially impractical because of complex designs requiring expensive specialty production and manufacturing. The excessive tooling, engineering, assembly of parts, and molding processes for adapting a receptacle to receive a dispenser produces an expensive receptacle.

Then in addition to the expense involved in producing a receptacle adapted to house and receive other parts are required. The dispenser portion must also be specially molded or manufactured similar to the way the adaptable receptacle was produced. After the dispenser has been produced to be housed in receptacle its use is limited.

After these receptacle and dispenser portion are produced then assembly is required. Several of the prior art references call for the installation of attachment parts such as: levers, hinges, rivets, screw, lugs, bolts, levers and like attachments. This labored assembly also inflates the price of production.

Until the dispensing concept is commercially practical and defeats expensive production cost mankind at large will not benefit from this convenient concept. Aside from the commercial impracticability other significant problems exist steaming from the functional limitations of the prior art some of these limitation are: U.S. Pat. Nos.; #5,738,239 to Triglia, Apr. 14, 1998 -#5,632,401 to Hurd, May 27, 1997 -#5,372,272 to Jennings, Dec. 13, 1994 show dispensers that set unattached or have unlocked top portions. They will not conveniently allow receptacle user to perform a function that is expected with receptacles. It has been overlooked that it is a very common practice when emptying waste from a lined receptacle to turn receptacle upside-down. To empty contents into a separate bag for the purpose of saving on liners. In result the stored liners and in some cases entire dispenser fall out. It is impractical to provide a receptacle that can not be conveniently over turned.

Most all of the prior art references have failed to provide convenient storage for the trash ties that accompany trash liners when purchased. The ties are provided within the packaging of trash liners as a means to secure top of full bag simply without having to manually tie a knot in top. The main purposes of dispensers are to provide convenient storage of liners and save steps by not having to retrieve liners from a separate location. It only makes sense to utilize the same convenience when retrieving trash ties.

Other functional limitations of prior art showing receptacle-dispensing combinations are In the event of a vital part failure within the combination. Placing of replacement parts in most cases can not be preformed.

U.S. Pat. Nos.; # 4,319,694 to Nehrbass, Mar. 16, 1994 and # 5,678,723 to Swift, Oct. 21, 1997 show dispensers that take up and waste space at the bottom of receptacle promoting the use of more liners.

The prior art fails to provide a means to hold liner at top of receptacle after a full liner is removed. The liner that is pulled to top of receptacle by the attached full liner is torn away and laid over the top of receptacle while the full liner is being tied. The empty liner because of its slick surface often slips back down into the receptacle. Then one must bend over and retrieve empty liner.

Another limitation of dispensers that are restricted to the base of receptacle is that industries such as restaurants have a lot of liquid waste and liners are frequently punctured by straws etc. A base dispenser is not as practical for use in situations where large amounts of liquid waste constantly leak down into the opening of dispenser.

An inconvenience occurs when a clean liner is desired for use outside of receptacle and the clean liners are in the base of receptacle attached to a bag of trash. Then you must remove bagged trash, tear liner top and bottom, throw out or replace into receptacle the un-full bag of trash. This temporarily breaks the sequence of liners causing the user to bend to retrieve the next liner.

There are also known in the prior art disposable liner dispensers and dispensers made of non-sturdy material. Shown in U.S. Pat. Nos. #Des. 297,415 to Gavin, Aug. 30, 1988 -#4,850,486 to Neibaur, Jul. 25, 1989 -#5,183,157 to Darden, Feb. 2, 1993 -#5,353,950 to Taylor, Oct. 11, 1994 -#5,671,847 to Pedersen, Sep. 30, 1997.

These types of dispensers do prove to be less expensive to produce than other dispensers. However, there are also significant problems with this type dispenser such as: Disposable dispensers are attached to surfaces mostly by the use of sticky type adhesives. Each time the dispenser is removed sticky residue is left on the surface where the dispenser was attached. Over a period of time, after removal of several of these dispensers the surface would be very hard to clean. Painted surfaces need repainting after removal of adhesive remove paint.

When this type of dispenser is used in a receptacle and removed the sticky residue causes the liner to stick to the receptacle. Upon removal of a thin liner that is stuck to receptacle it will tear spilling the enclosed waste.

Sticky adhesives used in receptacles and on other surfaces are more practical when the attached device serves a permanent or semi-permanent purpose.

Disposable dispensers in receptacle are also impractical in the event that spillage of liquids occurs the dispenser is not washable. Also, card boars and paper dispensers absorb liquids and all the enclosed liners would be sticky.

Also known in the prior art are dispensers of ornamental design that show an assortment of dispensers with limited use.

U.S. Pat. No. Des. 254,585 to LeCaire, Apr. 1, 1980 shows a bulky wall mount dispenser that has limited use because it would be impractical to use inside a receptacle taking up an excess amount of space away from the waste storing compartment of receptacle.

U.S. Pat. No. Des. 313,135 to Kloberg, Dec. 25, 1990 shows a mountable dispenser with vented design and a design with recess. These two designs require mounting in a fixed position and limit these dispensers to a wall mount position. Also no consideration has been given to the storage of trash ties.

U.S. Pat. No. Des. 325,311 to Mygind, Apr. 14, 1992 shows a complicated to manufacture dispenser requiring specialty molding and assembly.

U.S. Pat. No. Des. 347,575 to Davis Jun. 7, 1994 shows another bag dispenser with complicated design that would require such expensive production cost that it would be commercially impractical to offer to consumers for every day use.

U.S. Pat. No. Des. 383,934 to McNaughton, Sep. 23, 1997 shows a dispenser for house hold goods dispensed from a roll. The jagged edge separating device of this dispenser for cutting plastic food wrap and the like. This dispenser would not work with plastic bags. Rolled receptacle liners would be torn during dispensing then across the jagged teeth of said separating device.

U.S. Pat. No. Des. 385,135 to Ching, Oct. 21, 1997 shows an attractive dispenser that dose provide an eye pleasing product not meant to be attached to the bottom of a receptacle or in a hidden convenient location.

U.S. Patent No. Des. 304,136 to Severini, Oct. 24, 1989 shows a wall mount dispenser limited in its function by the design thereof.

U.S. Pat. No. Des. 409,027 to Simhaee, May 4, 1999 shows another dispenser of limited use. The open design doesn't allow mounting within a receptacle.

Another problem with receptacles is the suction within the receptacle that occurs when the user tries to remove a full liner of waste from receptacle. Often the user has to try to hold the receptacle with knees or one hand to separate receptacle from the full bag. This problem was partially addressed in U.S. Pat. No. 5,628,424 to Gola May 13, 1997 by the use of ventilation and an outwardly extending ring around outer bottom of receptacle. This method would be a waste of materials as the user would only need a small area in which to step on to hold the receptacle down while a full liner is removed.

While these devices fulfill their respective, particular objective and requirements, the aforementioned patents do not describe a waste receptacle with a suction swept debris pickup within receptacle and features to maximize total convenient use of receptacle liners.

In this respect, the waste receptacle and features for maximizing the convenient use of liners along with the swept debris pick up system according to the present invention substantially departs from the conventional concepts and designs of the prior art, and in doing so provides a more useful waste receptacle.

Therefore, it can be appreciated that there exists a continuing need for a new and improved waste receptacle with extended features for maximizing convenient use of liners and to provide a simple way to receive and store swept debris into receptacle.

BRIEF SUMMARY OF THE INVENTION

In the view of the foregoing disadvantages inherent in the known types of waste receptacles now present in the prior art, the present invention provides an improved waste receptacle with a versatile lining system, improved handles to hold liners and secure lid to receptacle, a toehold area to hold receptacle down when emptying a full liner creates a suction, a internal trash tie storage and improved method for receiving swept materials.

Accordingly, several objects and advantages of my invention are:

It is an object of the present invention to provide a versatile means for dispensing receptacle liners within a receptacle so that the receptacle user may choose where to place dispenser to best fit their individual needs.

It is another objective of the present invention to provide a dispensing means for receptacles that is made of sturdy construction and materials. That is also completely removable and washable and that has sturdy enough attachment to receptacle to stay in place during tilting or turning upside down of receptacle.

It is another objective of the present invention to provide dispensing means for liners of noncomplex design to defeat expensive production and assembly cost.

It is another objective of the present invention to provide a inexpensive means of storing trash ties conveniently inside of receptacle.

It is another objective of the present invention to provide a means of holding in place a liner that has been torn separate from a fill liner while the full liner is being securely tied. So the liner waiting to be turned down and fitted to receptacle dose not slip back down into the receptacle.

It is another objective of the present invention to provide a means of neatly securing a liner to top of receptacle to prevent the undesired appearance of bulky excess liner hanging over top. And at the same time provide a means of holding liner securely to top of receptacle while tilting or turning over and emptying contents of receptacle to conveniently reuse liner.

It is another objective of the present invention to provide a means of locking receptacle lid to receptacle to provide a sealed non-spilling receptacle that dose not allow odors to escape.

It is another object of the present invention to provide a means for receptacle user to hold receptacle down to floor when removal of a full liner of waste creates a suction that It is another object of the present invention to provide a easy method of receiving swept debris into receptacle with out all the steps involved in retrieving or using the standard dustpan.

It is another object of the present invention to provide storage of swept debris within receptacle that will store the debris over the period of several sweepings before emptying is needed.

Still further objects and advantages will become apparent from a consideration of the ensuing description and accompanying drawings.

BREIF DISCRIPTION OF THE SEVERAL VIEWS OF THE DRAWINGS

Figure 2:
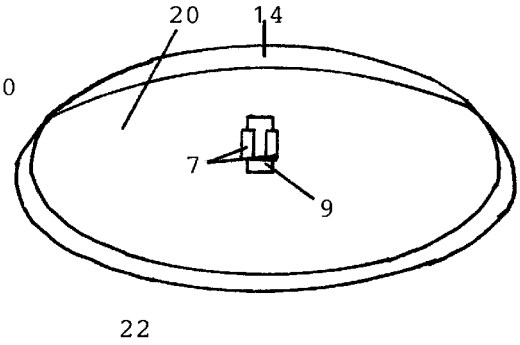
FIG. 2 is a perspective side view of the invention with lid open showing underside of lid.
Figure 2A:
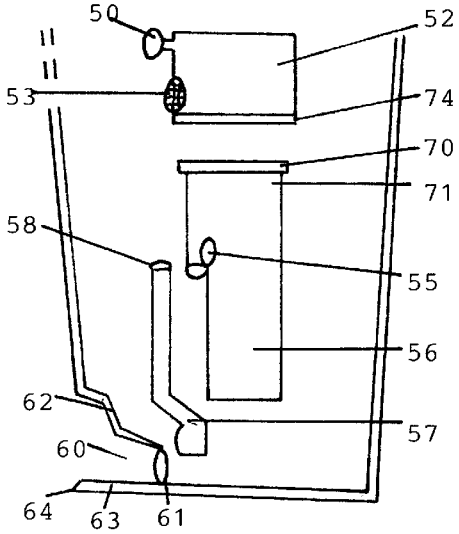
Figure 2A:
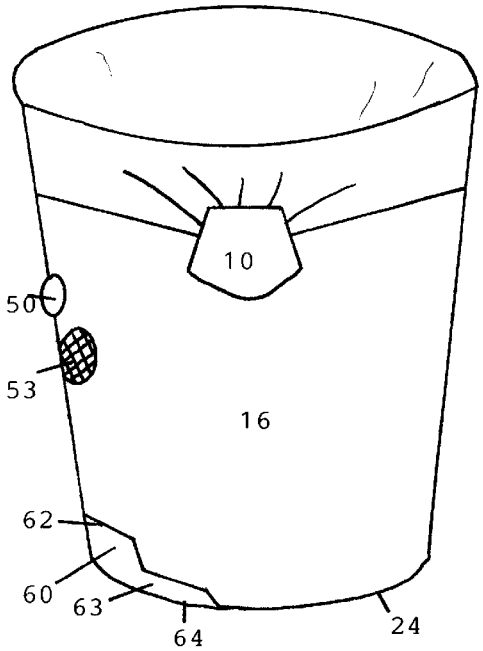

FIG. 2*a* is a partial cut open cross sectional view of the lower section of invention with the vacuum tube and debris storage container and vacuums housing shown in an exploded arrangement.

Figure 3:
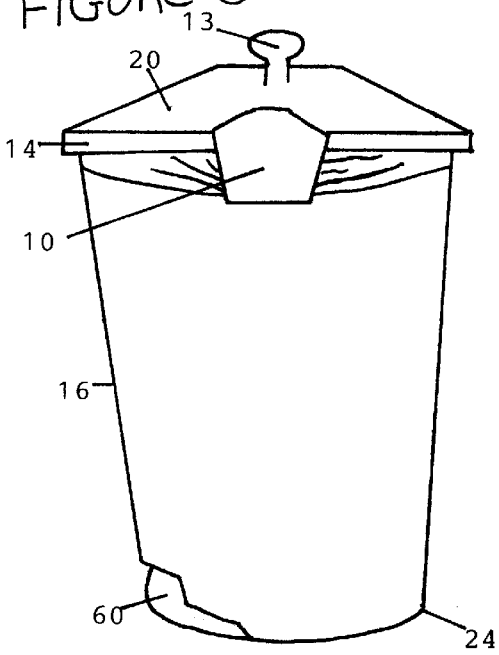

FIG. 3 is a side view of invention with handle 10 shown in locking connection with lid 20.

Figure 3A:
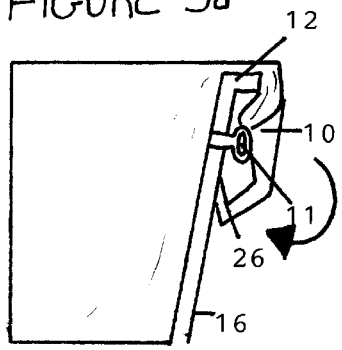

FIG. 3*a* is a partial cross sectional cut open view of handle 10 in a hinge open action.

Figure 3B:
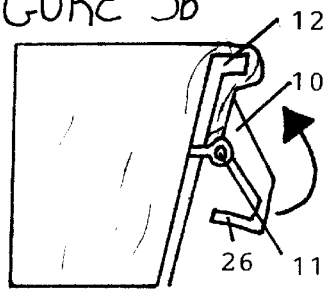

FIG. 3*b* is a partial cross sectional cut open view of handle 10 in a hinge-closed action.

Figure 3C:
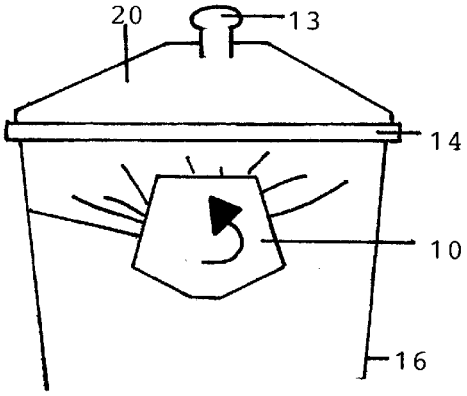

FIG. 3*c* is a partial side view to demonstrate a semi-circular rotation of handle 10.

Figure 3D:
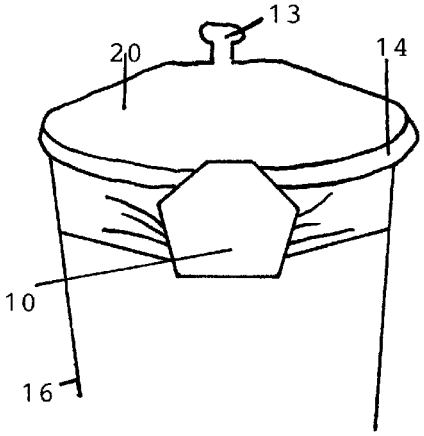

FIG. 3*d* is a partial side view to demonstrate handle 10 after semi-circular rotation.

Figure 3E:
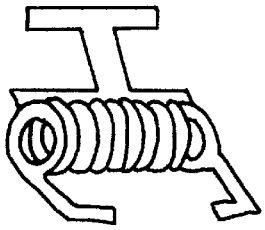

FIG. 3*e* is a perspective view of one of the rotational spring hinge 11.

Figure 4:
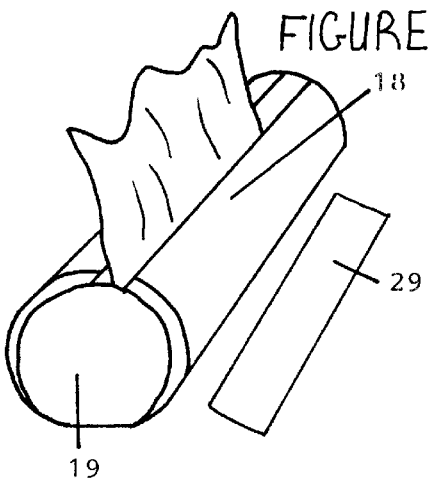

FIG. 4 is a perspective view of versatile dispenser 18 with lid 19 enclosing dispenser.

Figure 5:
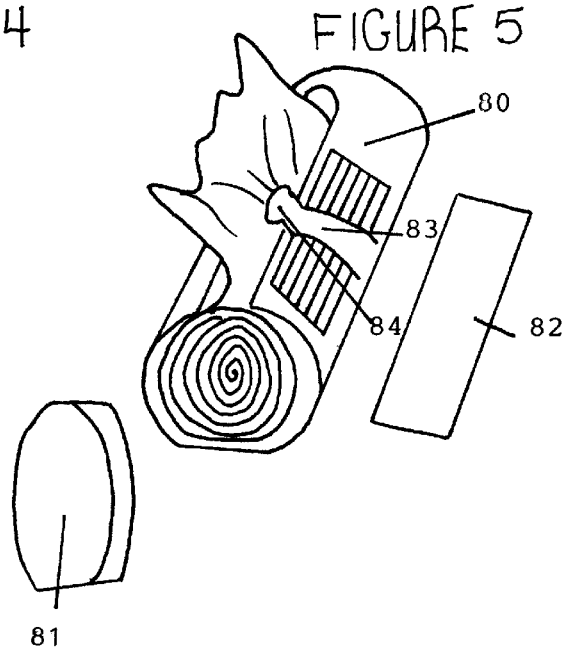

FIG. 5 is a perspective view of a second embodiment of dispenser 18

Figure 6:
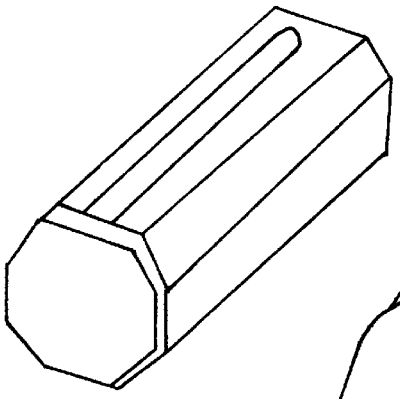
Figure 6A:
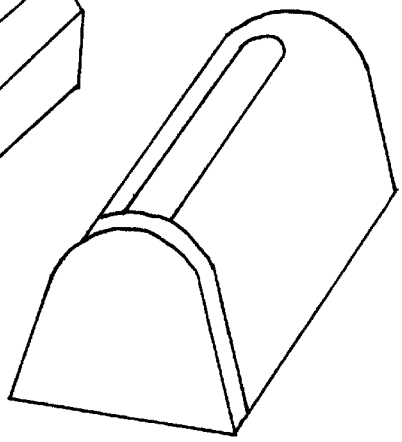
Figure 6B:
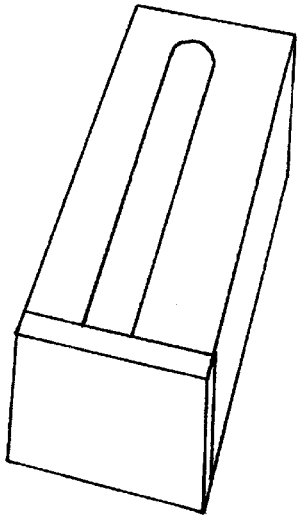

FIGS. 6, 6*a*, and 6*b* are perspective views of some alternative shapes of dispenser 18.

Figure 6C:
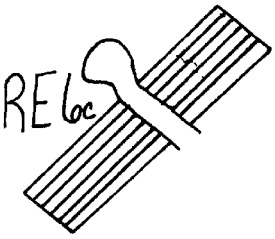

FIG. 6*c* is a perspective view of a trash tie holding device 83 and a liner separating device of an alternative dispenser 80.

PARTS REFERANCE LIST

7—a pair of holding devices
8—a internal trash tie storage compartment
9—a enclosure door
10—a pair of spring hinged rotational handles
11—a pair of rotational spring hinges
12—a outwardly turning rim at top of receptacle
13—a outwardly extending formed handle
14—a outwardly extending formed ledge type rim of receptacle lid
16—a pair of sidewalls to receptacle
18—a versatile dispenser
19—a lid with matching recess for dispenser 18
20—a lid to receptacle
22—a open upper end of receptacle
24—a closed lower end of receptacle
26—a pair of inwardly dimensioned latch portions of handles 10
29—a pair of sturdy velcro strips to attach dispenser 18
50—on / off switch of vacuum
52—hard plastic housing of vacuum
53—vent for vacuum motor
55—flap to cover open end of debris storage container
56—debris storage container
57—vacuum tube
58—open upper end of vacuum tube
60—a toe hold area
61—a open recess at inner back of toe hold area
62—inwardly formed recess at bottom of a sidewall to provide top of toehold area 60
63—a flat portion of receptacle base that provides bottom of toe hold area 60
64—downwardly slanted outer edge of toe hold area 60
70—a pair of outwardly formed ledges at upper open end of debris storage container 56
71—filter holding notches of debris storage container 56
74—a pair of receiving slots at bottom of hard plastic housing of vacuum 52
80—a attachable dispenser
81—a lid to attachable dispenser 80
82—an adhesive attachment of dispenser 80
83—a trash tie holding device of dispenser 80
84—a liner divider of dispenser 80

DETAILED DESCRIPTION OF THE INVENTION

With reference now to the drawings, and in particular, to FIGS. 1–6*c* thereof, the preferred embodiment of the improved features to provide more practical use of trash liners will be described.

Specifically, it will be noted in the various FIGURES that the devices relate to maximizing the convenient use of trash liners inside of trash receptacles. Such components can be independently configured to work separate from the illustrated combination to achieve separate desired objections. As well as they are also configured to work together in partial or total combination to achieve partial or total objection of the combination.

The features shown as a combination system show a receptacle container having an open upper end 22 a closed lower end 24 and side walls 16 there between. The receptacle container has an open upper end 22, outward turning rim 12 topping the sidewalls and surrounding the open upper end 22 of receptacle.

The main purpose of the outwardly extending formed handle 13 is to provide a convenient means of lifting and positioning the lid 20 of receptacle. The outwardly extending formed handle 13 also within its inward recess serve as the walls of the internal trash tie storage compartment 8. Shown in FIG. 1 and FIG. 2. The said handle 13 may be produced as part of lid 20 or added after production of said lid.

The main purpose of the internal trash tie storage compartment 8 is to provide convenient storage of trash ties within the lid 20 of receptacle. This said storage space could also serve as storage of other small items. The said storage compartment of 8 could serve as unique hidden storage of a key, note or money that may need to be left in a non obvious location. Said compartment 8 shown in FIG. 1.

The main purpose of the enclosure 4 is to serve as a bottom door for the trash tie storage compartment 8. A pair of holding devices 7 receives the enclosure door 9 by a slide in action Shown in FIG. 1. The said enclosure 9 is a separately manufactured part.

The main purpose of the pair of holding devices 7 is to receive the enclosure door 9 by a slide in and out action so that the internal trash tie storage compartment 8 is enclosed. Shown in FIG. 1 and shown in place in FIG. 2. The said holding devices 7 could be formed with lid 20 or added after production of said lid.

Figure 1:
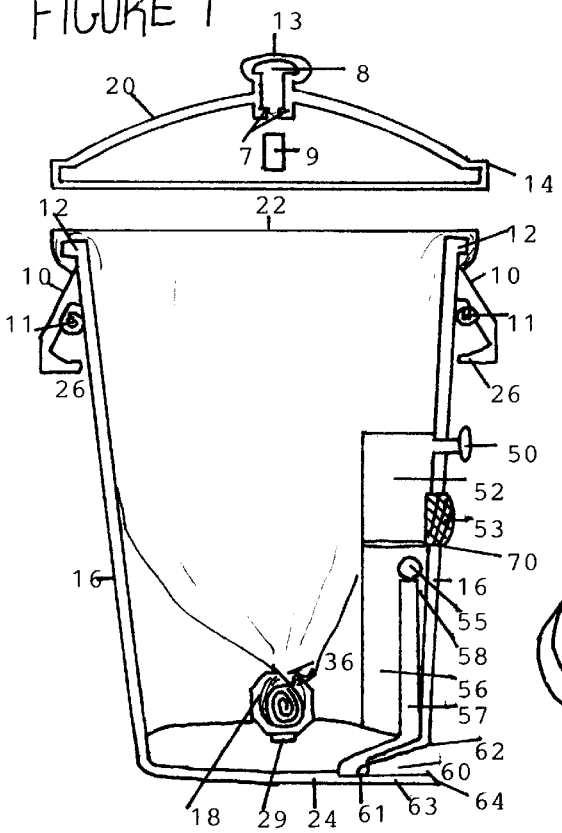
FIG. 1 is a cross sectional cut open view of the invention.

The lid 20 serves as a top of receptacle FIG. 1. The lid 20 also houses the outwardly extending formed handle 13 that collates with the pair of holding devices 7 and the enclosure door 9 to provide the internal trash tie storage compartment 8. FIG. 1 The lid 20 at its bottom portion comprises a outwardly extending formed ledge type rim 14 that receives the inwardly dimensioned latch portion 26 of the spring hinged rotational handles to provide a lock sealed container. FIG. 3 and FIG. 3*d* The lid 20 also serves as a means to hold in place a empty trash liner once the empty liner has been released from dispenser 18 it is pulled to top of receptacle by attachment to a full liner that is being pulled out. The lid 20 is set down on empty liner while the full and empty liner are torn apart from the perforated line. The lid 20 holds the empty liner between lid 20 and outward turning rim 12 at top of receptacle. To keep the empty liner from falling back down into receptacle while the full liner is tied securely and disposed of. Then the lid 20 is lifted and the empty liner is turned down and gathered under the spring hinged rotational handles 10. The lid 20 is preferably made as one part.

The pair of spring hinged rotational handles 10 serve three main purposes the first function is to serve as workable handles to carry the receptacle FIG. 1. The second main function of said handless 10 is to provide a means to securely hold the excess trash liner neatly in tact at top of receptacle and also to hold the top of liner in place during tilting and turning upside down of receptacle. The said handles 10 bend open by means of the pair of rotational spring hinges 11 to receive and hold the top of liner FIG. 2.

The third main function of said handles 10 is to proved with the outwardly extending formed ledge type rim 14 of lid 20 a latched locked sealed container. FIG. 3*d*. This said seal is achieved when the said handles 10 are turned in a semi-circle motion available FIG. 3*c*, by the a pair of rotational spring hinges 11 that mount between the said handles 10 and sidewalls 16 of receptacle FIG. 1. Then after the semi-circular turn the inwardly dimensioned latch portion 26 at inside bottom of said handles 10 is received by the outwardly extending formed ledge type rim 14 of lid 20. This action holds the lid 20 to the receptacle in a locked position FIG. 3*d* to hold in odors, and prevent spillage of contents in the event the receptacle is over turned by a animal or some other means FIG. 3. The said handles 10 can be secured to the outer surface of sidewalls as indicated in FIG. 1. Another of the many methods of attachment would be to extend the rotational attachment of said hinges 11 through a provided recess FIG. 3*a* and FIG. 3*b*. The said recess could be formed during manufacture of receptacle or achieved by the use of some piercing or puncturing tool or other method for providing such a recess.

The attachable dispenser 18 is separately molded and provided for dispensing a roll of trash liners into receptacle from the closed lower end 24 of receptacle if desired FIG. 1. The said dispenser 18 is attached by a sturdy velcro material for fastening made of matching strips velcro attachment 29 that is sturdy enough to hold the dispenser in place while the receptacle is tilted or turned upside down FIG. 1.

The attachable dispenser 18 is provided with the sturdy velcro attachment so that the receptacle owner may attach the dispenser 18 in whatever position to the receptacle that suits the individual needs of the receptacle owner. A restaurant receptacle for example that has a high occurrence of liquid spillage and torn liners may elect to attach the dispenser 18 onto inner or outer side walls 16 of receptacle, or they may elect to attach the dispenser 18 onto interior or exterior of lid 20 of receptacle. The other features of this invention still provide useful function even when the dispenser is mounted in various locations inside or outside of receptacle. The only difference in function when dispenser 18 is mounted in a position other than the closed lower end 24 of receptacle is the bag dose not position automatically when dispensed. Thus requiring the liner dispensed from other location be fitted to can before turning down and gathering excess top of liner under spring hinged rotational handles 10. The attachable dispenser 18 is also able to convert to use in a standard or other types of receptacles if desired. The sturdy Velcro material for fastening made of matching strips attachment 29 makes removal and washing easy and practical. The said velcro material of attachment 29 is very inexpensive to replace in the event it needed replacing for some reason. The said dispenser 18 comprises a hollow body portion with one closed end and one open end. A lid to dispenser 19 encloses the open end. Both the dispenser 18 and the lid to dispenser 19 have at their bottom portion a flat side. The said flat side is for the purpose of mounting.

A toe hold area 60 is located at the outer bottom of receptacle. This area is formed between a sidewall of receptacle and inner base of receptacle. To provide a inwardly formed recess 60 that is dimensioned to receive the toe and end portion of a human foot and to receive swept debris. The inwardly formed recess of the sidewall 61 meets a flat portion of the bottom of receptacle 63 that extends to meet outer sidewall of receptacle. The flat portion of the bottom of receptacle has a downward sloped outer edge 64. To provide a holding surface for the inserted foot to step on as well as to easily receive swept debris. The purpose of a toe hold area 60 is to provide the receptacle user a place to insert foot to hold the receptacle down when a full liner is being removed from receptacle. Thus allowing the user to use both hands as needed when removing a full liner from receptacle.

A vacuum with debris storage container 56 secured within receptacle. This is achieved when the toe hold 60 area is equipped with a recess opening 61. To receive vacuum tubing 57 at the back bottom and extends along the top of toe hold area 62 until it reaches the sidewall 16 then the tube extends upward along the inner sidewall a predetermined length to stop leaving a open top end of tube 58. A flap covered opening of a debris storage container 55 receives a top open end of the vacuum tube 58. The flap is made of lightweight rubber and is secured to inside of this container 56. When the vacuum is on the suction of the vacuum opens this flap and it is closed when the vacuum is off. The debris storage container also has a upper open end with a outwardly formed ledge 70 on two of the upper sides of the debris storage container 56. The two outwardly formed ledges 70 are slide in received by a pair of receiving slots 74 dimensioned to receive the formed ledges of the debris storage container. The receiving slots 74 are formed on the outer lower bottom of a hard plastic housing of the vacuum 52. A battery powers the vacuum motor. Venting of the vacuum is done through a open or grated recess in receptacle 53 sidewall dimensioned above the toe hold area. A on and off power switch 50 is located on outer sidewall of receptacle. The purpose of the vacuum and debris storage container within receptacle is to provide a simple way for the receptacle user to sweep a pile of debris close to the toe hold area of receptacle and turn on the vacuum to suck the debris into the debris storage container. So that the receptacle user dose not have to retrieve a dustpan and bend over to sweep the debris onto dustpan several times and knock the dustpan on inside of receptacle several times to knock all the loose debris from the dustpan before returning it to storage. Also the user can use the vacuum to clean any hair or loose debris from sweeping end of broom before returning broom to storage. By running the sweeping end of the broom by the toe hold area while the vacuum is on.

ALTERNATIVE EMBODIMENTS AND RAMIFICATIONS OF THE INVENTION

The versatile dispenser 18 has a second embodiment taught in this invention. The second embodiment of the versatile dispenser is for dispensing a roll of liners outside receptacle. The second embodiment of the versatile dispenser is the same dispenser as the versatile dispenser 18 with added modifications. The modifications I describe will define the second embodiment of the versatile dispenser that is named the attachable dispenser 80. The attachable dispenser 80 has a different type of opening at its top portion for dispensing liners FIG. 5. A recess opening for dispensing liners. A portion of a pair of sidewalls to the attachable dispenser 80 extend past this recess opening to join together near a closed end of a closed end of the attachable dispenser that is joined to the sidewalls at this end portion. A open end of the attachable dispenser 80 is the same as a open end of the versatile dispenser 18. The two dispenser lids are different. A enclosure lid to attachable dispenser 80 dose not have a matching recess FIG. 5 like a lid with matching recess to versatile dispenser 18. The purpose of a recess opening for dispensing liners being smaller on the attachable dispenser 80 is to aid in separating liners passing through this opening. Because when liners are dispensed from outside of receptacle it is desired that each liner tears along the provided perforated separation. The attachable dispenser has a trash tie holding device 83 for providing convenient storage of trash ties on the dispenser 80 stored outside of receptacle. A liner-dividing device 84 is provided at the end of the trash tie holding device that protrudes into the recess opening for dispensing liners on upper portion of attachable dispenser 80. This liner divider device 84 is outwardly formed to locate and separate liners at the provided perforation for separating each liner one from another. So that the user dose not roll the liners out to far causing them to have to re-roll the liners back into dispenser.

This attachable dispenser 80 has an attachable means similar to that of the versatile dispenser 18. The attachment of the attachable dispenser is provided by a sturdy double sided peel and stick type adhesive 82. This attachment is for mounting to most any surface in a semi-permanent position. This adhesive attachment 82 of the attachable dispenser 80 allows the user to mount dispenser inside cabinet doors on shelves or to most any surface where storage of liners is desired. This mounting to these type surfaces has not been suggested in the prior art but would provide needed convenience to liner users.

The attachment of the two dispensers could be altered in many ways such as the attachments 29 and 82 could be changed by swapping the velcro attachment for the adhesive or visa versa. The attachment of the dispensers to receptacle or other surfaces may also be achieved in several other ways for some examples would be brackets, slide fit base plates, the dispenser could be fixed to receptacle by heat, and numerous other attachments.

The recess openings of the dispensers may be altered in several ways also. The shape of the dispenser could altered in many ways other than the shapes illustrated in FIGS. 4,5,6,6*a*, and 6*b*.

The trash tie holding device 83 or the liner dividing device 84 may also take on many different shapes or sizes or combinations not illustrated in the drawings FIG. 5 and FIG. 6*c*.

The holding devices 7 could be molded with lid as glide slots or replaced altogether with some other types of holding apparatuses.

The rotational spring hinges 11 may be modified to provide only one of their stated functions or their function may be extended.

All of the features of this invention may be altered in shape, attachment or arrangement different than the illustrated combination of the preferred embodiment illustrated in this invention discussion.

Thus the reader can see that the waste receptacle with improved convenient lining features and swept debris pick up provides a more useful, yet economical device that can be used by persons of almost any age to save time and physical exertion.

While my above description contains many specificities, these should not be construed as limitations on the scope of the invention, but rather as an exemplification of one preferred embodiment thereof. Many other variations are possible. For example the features shown in the drawings could be incorporated in a receptacle mounted under a counter.

Accordingly, the scope of the invention should be determined not by the embodiment illustrated, but by the appended claims and their equivalents.

What I claim as my invention is:

1. A waste receptacle with liner dispenser and holding system for supplying and securing a continuous supply of liners and liner ties to receptacle, with a system to pick up and store swept debris within a container comprising, in combination:

a waste receptacle having an open upper end, a closed lower end, sidewalls there between and a lid enclosure, a bottom portion of a sidewall of receptacle has a inwardly formed recess enclosed by a flat portion of receptacle base, a toe hold area is formed there between, the toe hold area has a dimensioned recess to receive a section of vacuum tube that extends upwardly and is secured along inner sidewall of receptacle, the vacuum tube is received by a removable debris storage container, the debris storage container has a filter holding means and is removable received by a vacuum housing assembly that houses a vacuum and is also secured to sidewall of receptacle;

a pair of handles is positioned vertically opposing each other on outer upper portion of receptacle sidewalls, these handles have a means to clamp open and shut, these handles have a means to perform a rotational function, upon rotation of handles a bottom inwardly dimensioned latch portion of the handles receive in lock position; a ledge type portion at the bottom lid to receptacle, this lid to receptacle has within its outwardly extending formed handle an enclosed trash tie storage compartment;

a versatile dispenser for storing and dispensing liners to receptacle has a flat bottom with sides that join two sidewalls of dispenser then extend upwardly and stop to leave a recess opening that extends the length of the sidewalls, the sidewalls and flat bottom are joined to a end of dispenser to form a closed end, the other end of dispenser is open, this open end is enclosed by a lid to dispenser that has a recess upon lid that matches the width of the recess in dispenser left open by the sidewalls, the attachment of this dispenser is left to the user to mount in any position they desire to fit their individual dispensing needs.

2. A waste receptacle of claim 1 comprising handles that have means to spring open and shut to receive and clamp onto a liner of receptacle wherein the means is a spring action of a pair rotational spring hinges.

3. A waste receptacle of claim 1 comprising handles that have means of rotation wherein the means is a function of the rotational portion of a pair of rotational spring hinges.

4. A waste receptacle of claim 1 comprising handles that have formed means to be received by lid of receptacle after a rotational function on handles.

5. A waste receptacle lid of claim 1 comprising a means to receive handles after a rotation of handles.

6. The waste receptacle of claim 1 whereby the versatil dispencing means can be mounted to any surface outside or inside of receptacle, or onto other surfaces outside of receptacle such as walls, cabinets or shelves based on the needs of the individual user.

7. The waste receptacle of claim 1 said dispenser having a recess that opens from the closed end of dispenser to an open end of dispenser that is enclosed by a lid with matching recess.

8. The waste receptacle of claim 1 whereby a attachable dispenser comprises a trash tie holding device, a liner dividing device, a lid without recess and a similar attachment as the versatile dispenser.

* * * * *